US011993433B2

(12) United States Patent
Bevier

(10) Patent No.: US 11,993,433 B2
(45) Date of Patent: May 28, 2024

(54) SHIPPING AND DISPENSING CONTAINER

(71) Applicant: INTERNATIONAL PAPER COMPANY, Memphis, TN (US)

(72) Inventor: Alex Dean Bevier, Fresno, CA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 17/573,892

(22) Filed: Jan. 12, 2022

(65) Prior Publication Data

US 2023/0219713 A1 Jul. 13, 2023

(51) Int. Cl.
*B65D 5/54* (2006.01)
*B65D 5/02* (2006.01)

(52) U.S. Cl.
CPC ..... *B65D 5/5435* (2013.01); *B65D 5/0227* (2013.01); *B65D 5/5445* (2013.01)

(58) Field of Classification Search
CPC ..... B65D 5/5445; B65D 5/5475
USPC ..... 229/235, 240–244
See application file for complete search history.

(56) References Cited

U.S. PATENT DOCUMENTS 3,278,080 A * 10/1966 Di Luco ..... B65D 83/00 221/268
4,000,811 A * 1/1977 Hardison ..... B65D 5/5405 229/242
5,651,497 A * 7/1997 Ventura ..... B65D 5/5415 229/235
5,979,749 A 11/1999 Bozich
7,249,703 B2 * 7/2007 Leapman ..... B65D 25/22 414/288
7,614,543 B1 * 11/2009 Miller ..... B65D 71/36 206/755
8,118,212 B2 * 2/2012 Miller ..... B65D 5/703 221/48
8,167,194 B2 * 5/2012 DeBusk ..... B65D 71/36 229/122
8,752,708 B2 6/2014 Keefe
8,844,728 B2 * 9/2014 James ..... B65D 5/5445 206/774

(Continued)

FOREIGN PATENT DOCUMENTS

DE 202019105396 U1 11/2019
FR 2928355 A1 * 9/2009 ..... A47F 1/125

(Continued)

*Primary Examiner* — Nathan J Newhouse
*Assistant Examiner* — Phillip D Schmidt
(74) *Attorney, Agent, or Firm* — Robert L. Showalter; Thomas W. Ryan

(57) ABSTRACT

A container is provided comprising: a bottom panel, at least one top panel, a first side panel, a second side panel, a plurality of front flanges and a plurality of back flanges, wherein the panels and flanges are connected together to define the container. Back lines of separation are formed in the first and second side panels, the at least one top panel and at an interface between the bottom panel and one of the back flanges such that a removable back portion can be separated from a remainder of the container via the back lines of separation so as to create a product exit opening. Front lines of separation are formed in one of the front flanges to define a tab, which is partially separable from a remainder of the one front flange.

6 Claims, 12 Drawing Sheets

(56) References Cited

U.S. PATENT DOCUMENTS

| | | | | |
|---|---|---|---|---|
| 8,997,997 | B2 * | 4/2015 | Close | A47F 1/125 206/804 |
| 2001/0001447 | A1 * | 5/2001 | Gregory | B65D 5/5253 206/746 |
| 2002/0043554 | A1 | 4/2002 | White et al. | |
| 2005/0178687 | A1 * | 8/2005 | Spivey | B65D 71/36 206/139 |
| 2006/0102706 | A1 * | 5/2006 | Spivey, Sr. | B65D 71/36 229/242 |
| 2011/0049226 | A1 | 3/2011 | Moreau et al. | |
| 2011/0284621 | A1 | 11/2011 | Couture | |
| 2012/0018503 | A1 * | 1/2012 | Walling | B65D 5/725 229/122.1 |
| 2013/0306718 | A1 | 11/2013 | Sumpmann et al. | |
| 2018/0305071 | A1 | 10/2018 | Purkey et al. | |
| 2019/0016501 | A1 | 1/2019 | Djokovic et al. | |
| 2021/0261286 | A1 * | 8/2021 | Couture | B65D 5/5445 |
| 2022/0097903 | A1 * | 3/2022 | Couture | B65D 5/5445 |

FOREIGN PATENT DOCUMENTS

| | | | | | |
|---|---|---|---|---|---|
| GB | 2377925 | A | * | 1/2003 | B65D 5/545 |
| GB | 2378178 | A | * | 2/2003 | B65D 5/4802 |
| GB | 2530339 | A | * | 3/2016 | B65D 5/5002 |
| KR | 20120002662 | U | * | 4/2012 | |
| PT | 849183 | E | * | 12/2008 | |
| WO | WO-2012145515 | A1 | | 10/2012 | |

* cited by examiner

SHIPPING AND DISPENSING CONTAINER

FIELD OF THE DISCLOSURE

This invention relates generally to packaging and, more particularly, to a container adapted to be shipped with product inside and, once received at a point of sale, a portion of the container can be removed to allow the product inside to be easily dispensed.

BACKGROUND

Containers fabricated from paperboard, e.g., corrugated fiberboard or corrugated paperboard, are often used to store and transport goods. Such containers may be formed from a blank of sheet material (hereinafter "blank"), which is folded along a plurality of preformed fold lines and glued to form an erected container. One such container is disclosed in U.S. Patent Application Publication No. 2021/0261286, wherein the container is adapted to enclose product and has a portion, which is removable from a remaining portion of the container to define an opening to allow for access to the product.

SUMMARY

In accordance with a first aspect, a container is provided that is adapted to contain product. The container may comprise: a bottom panel, at least one top panel, a first side panel, a second side panel, a plurality of front flanges and a plurality of back flanges, wherein the panels and flanges may be connected together to define the container. Back lines of separation may be formed in the first and second side panels, the at least one top panel and at or near an interface between the bottom panel and one of the back flanges such that a removable back portion can be separated from a remainder of the container via the back lines of separation so as to create a product exit opening. Front lines of separation may be formed in one of the front flanges to define a tab, which is partially separable, wherein the front lines of separation may be spaced away from the at least one top panel and the tab continues to be joined at or near a lower end of the one front flange or an adjacent portion of the bottom panel when the tab is partially separated.

The tab may include a grasping opening allowing a user to grasp the partially separated tab with one hand while the user inserts his/her other hand through an opening created by the partially separated tab after being separated from the remainder of the one front flange to push product out through the product exit opening.

The at least one top panel may comprise first and second top panels.

The at least one top panel may comprise a primary top panel and may further comprise a glue flap coupled to the primary top panel along a longitudinal edge of the primary top panel.

The one front flange may be hingedly connected to a lateral edge of the bottom panel.

Each of the first and second side panels may comprise opposing lateral edges and opposing longitudinal edges, wherein a back line of separation may extend across each of the first and second side panels from a first location near one of the corresponding lateral edges and one of the corresponding longitudinal edges to a second location near another one of the corresponding longitudinal edges but spaced from the corresponding lateral edges.

In accordance with a second aspect, a blank is provided for constructing a container comprising: a bottom panel having opposing longitudinal edges and opposing lateral edges; a first side panel hingedly connected to one of the longitudinal edges of the bottom panel; a second side panel hingedly connected to another one of the longitudinal edges of the bottom panel; at least one top panel hingedly connected to a longitudinal edge of one of the first or second side panels; a plurality of front flanges; and a plurality of back flanges. Back lines of separation may be formed in the first and second side panels, the at least one top panel and at or near an interface between the bottom panel and one of the back flanges. Front lines of separation may be formed in one of the front flanges to define a tab and to allow the tab to be partially separated from a remaining portion of the blank.

The tab may include a grasping opening.

The at least one top panel may comprise first and second top panels.

The at least one top panel may comprise a primary top panel. A glue flap may be further provided and coupled to the primary top panel along a longitudinal edge of the primary top panel.

The one front flange may be hingedly connected to a lateral edge of the bottom panel.

Each of the first and second side panels may comprise opposing lateral edges and opposing longitudinal edges. A back line of separation may extend across each of the first and second side panels from a first location near one of the corresponding lateral edges and one of the corresponding longitudinal edges to a second location near another one of the corresponding longitudinal edges but spaced from the corresponding lateral edges.

In accordance with a third aspect, a container is provided that is adapted to contain product. The container may comprise: a front panel, a back panel, a first side panel, a second side panel, a plurality of top flanges and a plurality of bottom flanges, wherein the panels and flanges are connected together to define the container. Back lines of separation may be formed in the first and second side panels, first and second ones of the top flanges and at or near an interface between the back panel and one of the bottom flanges such that a removable back portion can be separated from a remainder of the container via the back lines of separation so as to create a product exit opening. Front lines of separation may be formed in the front panel to define a tab, which is partially separable, wherein the front lines of separation are spaced away from the top flanges and the tab continues to be joined at or near a lower end of the front panel or at a portion of an adjacent one of the bottom flanges when the tab is partially separated.

The tab may include a grasping opening allowing a user to grasp the partially separated tab with one hand while the user inserts his/her other hand through an opening created by the partially separated tab after being separated from the remainder of the front panel to push product out through the product exit opening.

The front panel may be hingedly connected to a lateral edge of one of the bottom flanges.

Each of the first and second side panels may comprise opposing lateral edges and opposing longitudinal edges, wherein a back line of separation extends across each of the first and second side panels from a first location near one of the corresponding lateral edges and one of the corresponding longitudinal edges to a second location near another one of the corresponding lateral edges but spaced from the corresponding longitudinal edges.

In accordance with a fourth aspect, a blank is provided for constructing a container comprising: a front panel having opposing longitudinal edges and opposing lateral edges; a back panel having opposing longitudinal edges and opposing lateral edges; a first side panel hingedly connected to one of the longitudinal edges of the back panel; a second side panel hingedly connected to another one of the longitudinal edges of the back panel; a plurality of top flanges; and a plurality of bottom flanges. Back lines of separation may be formed in the first and second side panels, first and second ones of the top flanges and at or near an interface between the back panel and one of the bottom flanges. Front lines of separation may be formed in the front panel to define a tab to allow the tab to be partially separated from a remaining portion of the blank.

The tab may include a grasping opening.

The front panel may be hingedly connected to a lateral edge of one of the bottom flanges.

Each of the first and second side panels may comprise opposing lateral edges and opposing longitudinal edges, wherein a back line of separation may extend across each of the first and second side panels from a first location near one of the corresponding lateral edges and one of the corresponding longitudinal edges to a second location near another one of the corresponding lateral edges but spaced from the corresponding longitudinal edges.

BRIEF DESCRIPTION OF THE DRAWINGS

While the specification concludes with claims particularly pointing out and distinctly claiming the subject matter of the present disclosure, it is believed that the subject matter will be better understood from the following description in conjunction with the accompanying Drawing Figures, in which like reference numerals identify like elements, and wherein:

DETAILED DESCRIPTION

Figure 2:
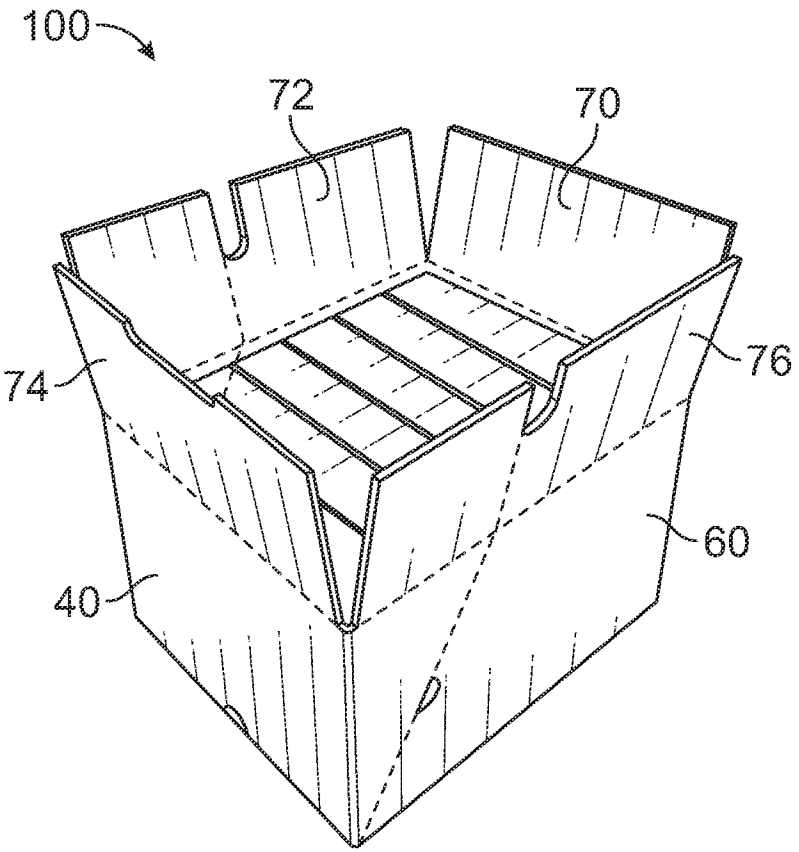
FIG. 2 is a perspective view of the container of FIG. 1 after the boxes of product have been inserted into the container.

In the following detailed description of the preferred embodiments, reference is made to the accompanying drawings that form a part hereof, and in which is shown by way of illustration, and not by way of limitation, specific preferred embodiments in which the subject matter of this disclosure may be practiced. It is to be understood that other embodiments may be utilized and that changes may be made without departing from the spirit and scope of the present disclosure.

Referring to FIGS. 1-7, a first embodiment of the present disclosure is directed to a shelf dispensing container or box 100 adapted to receive product, such as a plurality cereal boxes 12. Any other product, including one or more bags filled with items, boxes filled with other items or individual items not packaged in a bag or box, may be inserted into the container 100. The container 100 is adapted to be shipped with product inside where the structure of the container 100 stays intact during shipping. However, at a retailer, such as a grocery, the container 10 is adapted to be easily opened by removing a back portion 110 to create a product exit opening 110A so as to allow product to be easily dispensed onto a shelf or like surface, see FIGS. 3-7. A tab 120 may be partially separated at a front portion of the container 100 allowing a user to grasp the partially separated tab 120 with one hand H1 while the user inserts his/her other hand H2 through an opening 120A created by the partially separated tab 120 to push product 12 out through the product exit opening 110A onto the shelf or the like, see FIGS. 6 and 7. The container 100 may be formed from a blank B, see FIG. 8.

Figure 8:
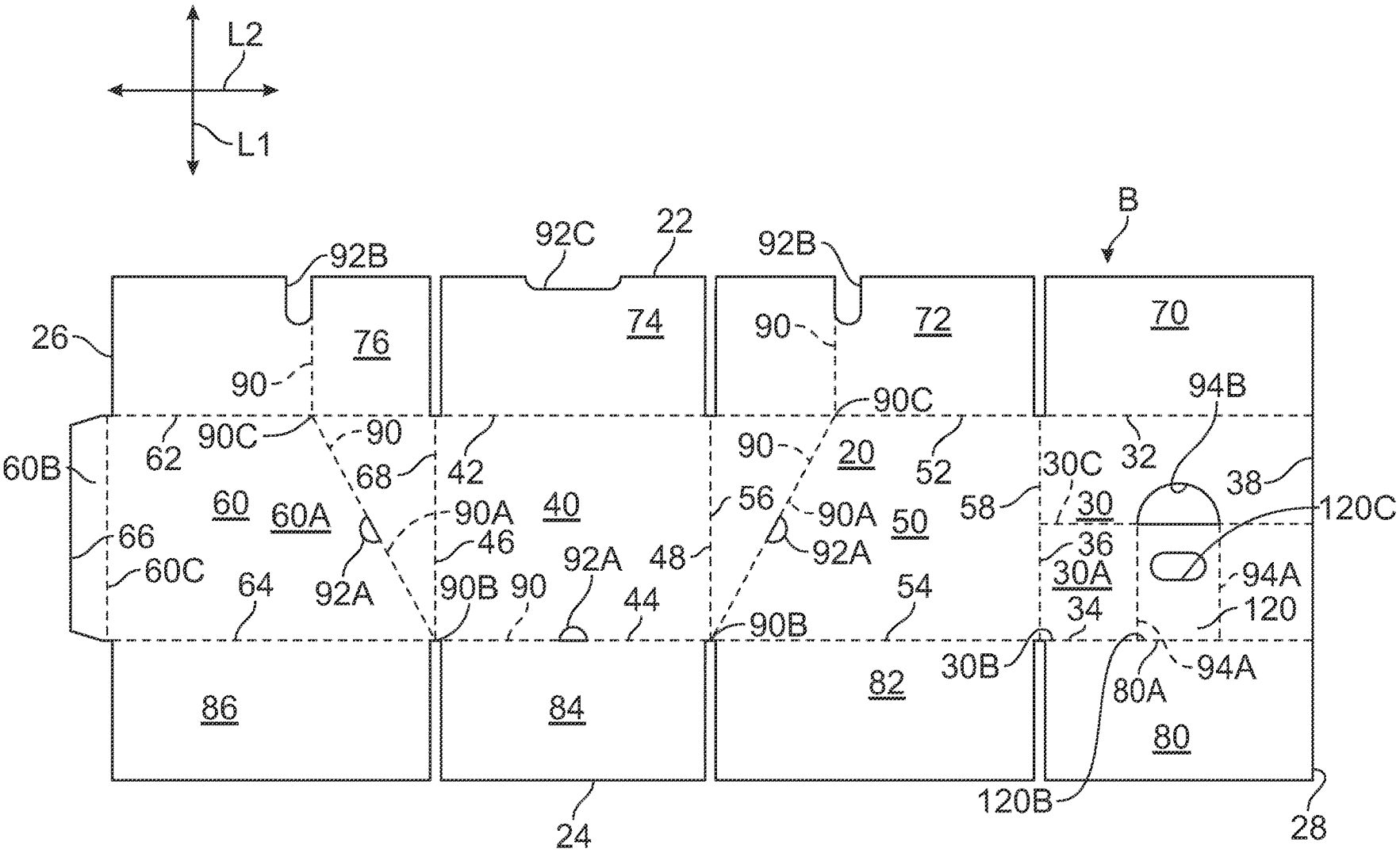
FIG. 8 is a plan view of a blank used to form the container of FIGS. 1-7.

The blank B may be formed from paperboard, e.g., corrugated fiberboard or corrugated paperboard, and may be die cut to the shape shown herein, although other materials and variations of the illustrated shape may be provided within the scope of the container described and claimed herein. The blank B illustrated in FIG. 8 is a planar piece of material in which the inner side 20 is shown facing out of the page. The blank B extends in a lateral direction $L_1$ between first and second lateral edges 22 and 24, respectively, and further extends in a longitudinal direction $L_2$ between first and second longitudinal edges 26 and 28, respectively.

The blank B may comprise a front panel 30 having opposing lateral edges 32 and 34 and opposing longitudinal edges 36 and 38 and a back panel 40 having opposing lateral edges 42 and 44 and opposing longitudinal edges 46 and 48. A first side panel 50 having opposing lateral edges 52 and 54 and opposing longitudinal edges 56 and 58 may be hingedly connected to the longitudinal edge 36 of the front panel 30 at a fold line and to the longitudinal edge 48 of the back panel 40 along a fold line. A second side panel 60 having opposing lateral edges 62 and 64 and opposing longitudinal edges 66 and 68 may be hingedly connected to the longitudinal edge 46 of the back panel 40 along a fold line. The second side panel 60 comprises a main side panel 60A and a glue flap 60B coupled to a longitudinal edge 60C of the main side panel 60A.

A first top flange 70 is hingedly connected to the front panel 30 along a fold line defined at the lateral edge 32 of the front panel 30; a second top flange 72 is hingedly connected to the first side panel 50 along a fold line defined at the lateral edge 52 of the first side panel 50; a third top flange 74 is hingedly connected to the back panel 40 along a fold line defined at the lateral edge 42 of the back panel 40; and a fourth top flange 76 is hingedly connected to the second side panel 60 along a fold line defined at the lateral edge 62 of the second side panel 60.

A first bottom flange 80 is hingedly connected to the front panel 30 along a fold line defined at the lateral edge 34 of the front panel 30; a second bottom flange 82 is hingedly connected to the first side panel 50 along a fold line defined at the lateral edge 54 of the first side panel 50; a third bottom flange 84 is hingedly connected to the back panel 40 along a fold line defined at the lateral edge 44 of the back panel 40; and a fourth bottom flange 86 is hingedly connected to the second side panel 60 along a fold line defined at the lateral edge 64 of the second side panel 60.

Figure 3:
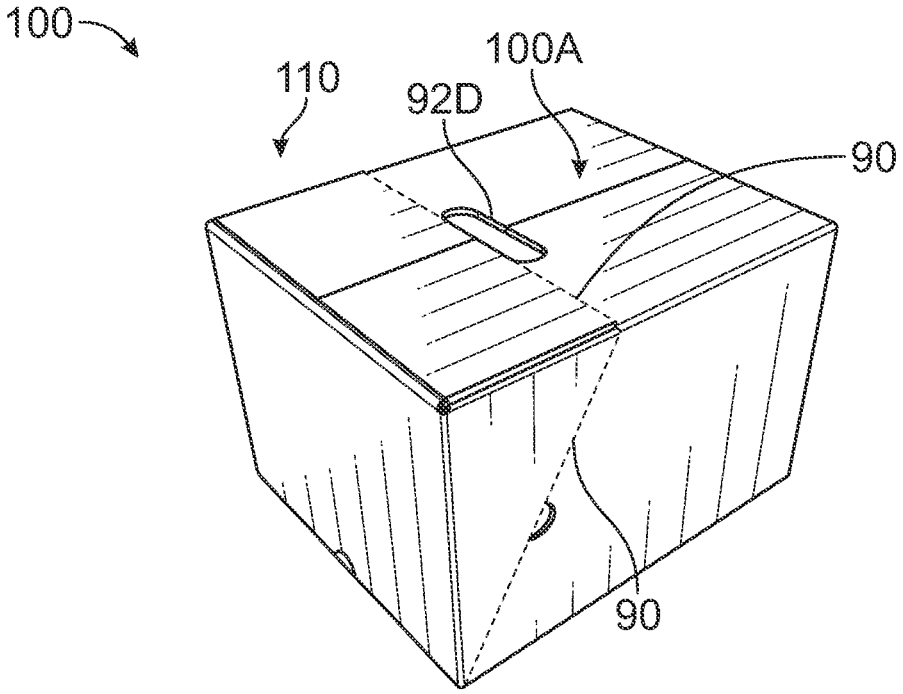
FIGS. 3 and 4 are perspective views of the container of FIGS. 1 and 2 after top flanges have been folded and secured in place.
Figure 4:
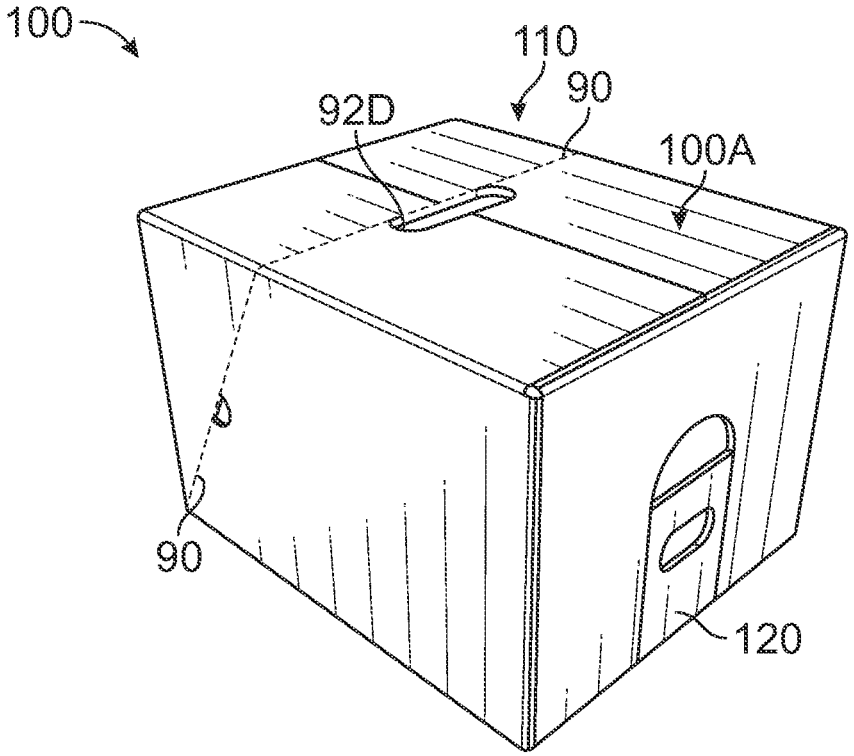
Figure 5:
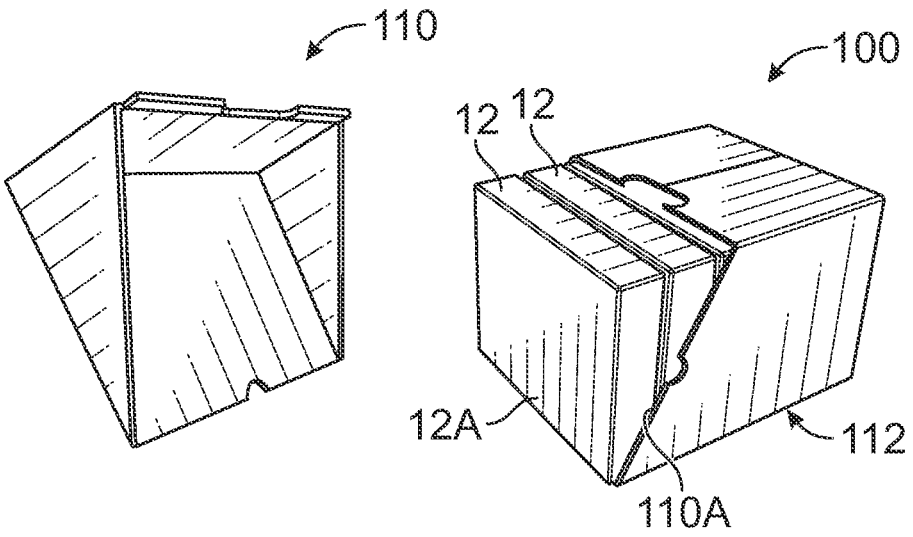
FIG. 5 illustrates the container of FIGS. 1-4 after a back portion has been removed.
Figure 6:
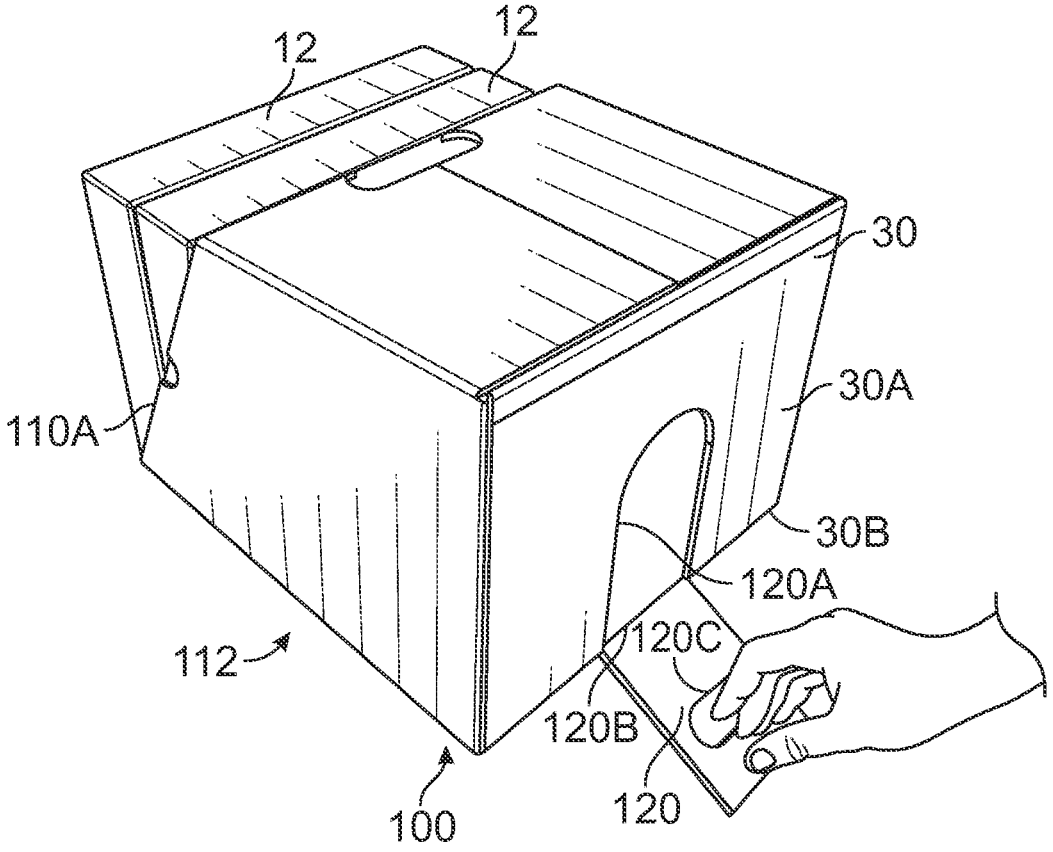
FIG. 6 illustrates the container of FIG. 5 after a tab has been partially separated.
Figure 7:
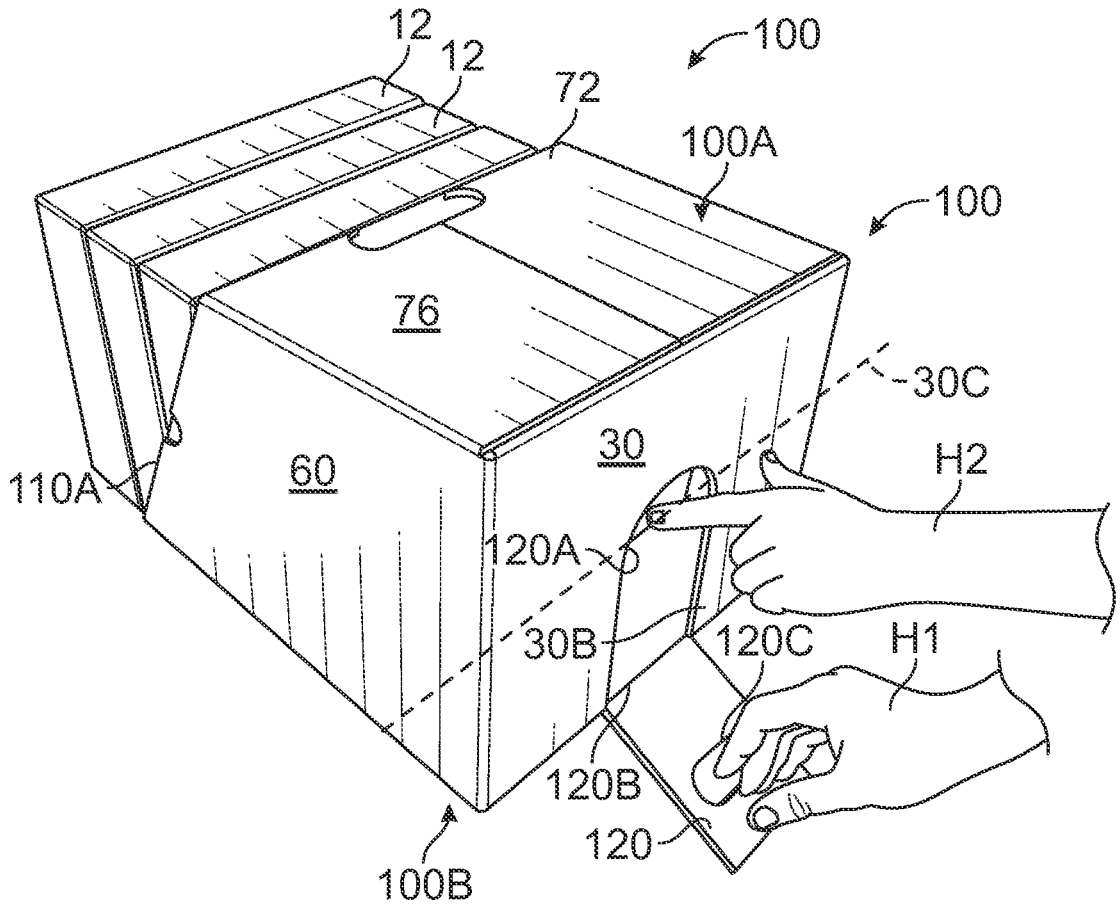
FIG. 7 illustrates the container of FIG. 5 showing a user grasping the tab with one hand and pushing boxes of product out of the container with the other hand.

Back lines of separation 90 may be formed in the first and second side panels 50 and 60, the second and fourth top flanges 72 and 76 and at or near an interface, i.e., at or near the lateral edge 44 of the back panel 40, between the back panel 40 and the third bottom flange 84 to define the outer periphery of the removable back portion 110, see FIGS. 3 and 4. The back lines of separation 90 may comprise score lines, nicked cut lines or perforation lines and allow the removable back portion 110 to be manually separated by a user via the back lines of separation 90 from a remainder 112 of the container 100 so as to create the product exit opening 110A.

The back lines of separation 90A formed in each of the first and second side panels 50 and 60 may extend at an angle across each of the first and second side panels 50 and 60 from a first location 90B near one of the corresponding lateral edges 54/64 and one of the corresponding longitudinal edges 56/68 to a second location 90C near another one of the corresponding lateral edges 52/62 but spaced from the corresponding longitudinal edges 56/58/66/68. The back lines of separation 90A may be linear or curved.

Finger holes or openings 92A may be provided in the back panel 40, and the first and second side panels 50 and 60, see FIG. 8, to allow a user to easily grasp the back portion 110 to remove the back portion 110 from the remainder 112 of the container 100. Slots 92B may be provided in the second and fourth top flanges 72 and 76 and a recess 92C may be formed in the third top flange 74 to define a gripping opening 92D when the blank B is formed into the container 100, see FIGS. 3 and 4, to allow a user to easily grasp the back portion 110 to remove the back portion 110 from the remainder 112 of the container 100.

Front lines of separation 94A, such as score lines, nicked cut lines or perforation lines, and a notch 94B (area of no material) may be formed in the front panel 30 to define the tab 120, wherein the tab 120 may extend to the lower lateral edge 34 of the front panel 30 in the illustrated embodiment, see FIG. 8. Preferably, the front lines of separation 94A are spaced away from the first top flange 70, see FIG. 8. A score line, nicked cut line or perforation line, i.e., a further front line of separation, may be provided in place of the notch 94B. A user can access the tab 120 via the notch 94B and pull the tab 120 away from a remainder 30A of the front panel 30 such that the tab 120 separates along the front lines of separation 94A. The separated tab 120 continues to be joined to the container 100 along a lower edge 120B of the tab 120 and at or near a lower end 30B of the front panel or a portion 80A of the first bottom flange 80, see FIGS. 6 and 7. A gripping opening 120C may be formed in the tab 120. A user may grasp the partially separated tab 120 via the gripping opening 120C with one hand H1 while the user inserts his/her other hand H2 through the opening 120A in the front panel 30 created by the partially separated tab 120 to push product 12 out through the product exit opening 110A onto a shelf or the like, see FIGS. 6 and 7. It is advantageous that the tab 120 remains joined at or near the lower end 30B of the front panel 30. Items or product within the boxes 12 may settle to the bottom 12A of the boxes 12 during shipping. Hence, the center of mass of each box 12 and the contents within the box 12 may be positioned below a middle plane 30C of the container 100 extending generally between a top 100A of the container and a bottom 100B of the container. In order to reduce the likelihood that the boxes 12 may bind on the inner surfaces of the first and second side panels 50 and 60 and/or one or more of the top flanges 70, 72 and 76 as they are pushed out of the container 100, it is preferred that the opening 120A extend from near the middle plane 30C to point at or near the lower end 30B of the front panel 30 to allow the user's other hand H2 to apply a force directly in-line with the center of mass of the boxes 12, which may be located below the middle plane 30C, wherein the force may be a substantially horizontal force if the container 100 is positioned on a horizontal surface.

Figure 9:
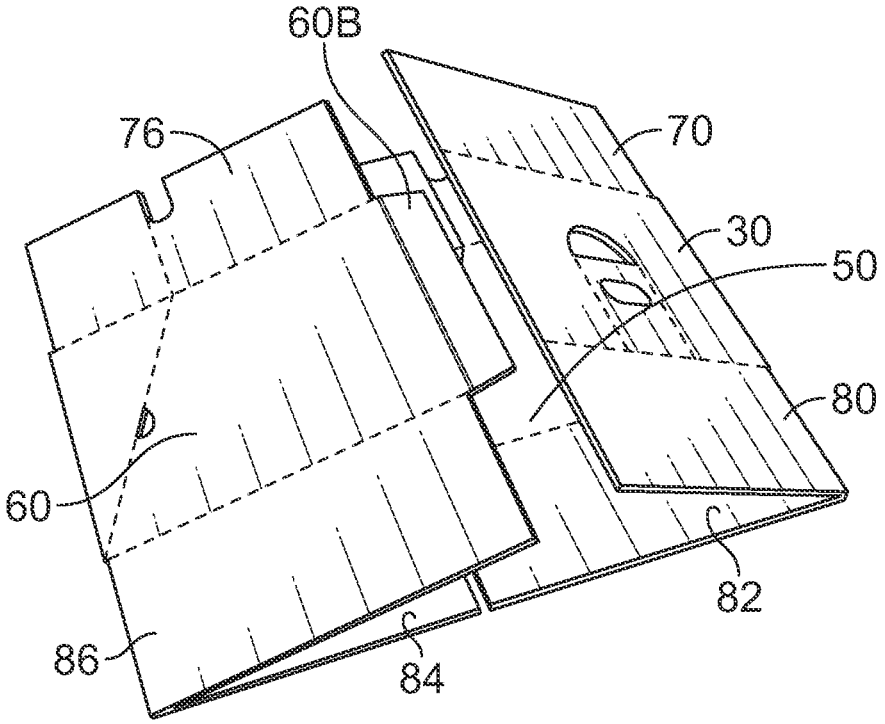
FIGS. 9 and 10 illustrate steps for folding the blank of FIG. 8 into the container of FIG. 1.
Figure 10:
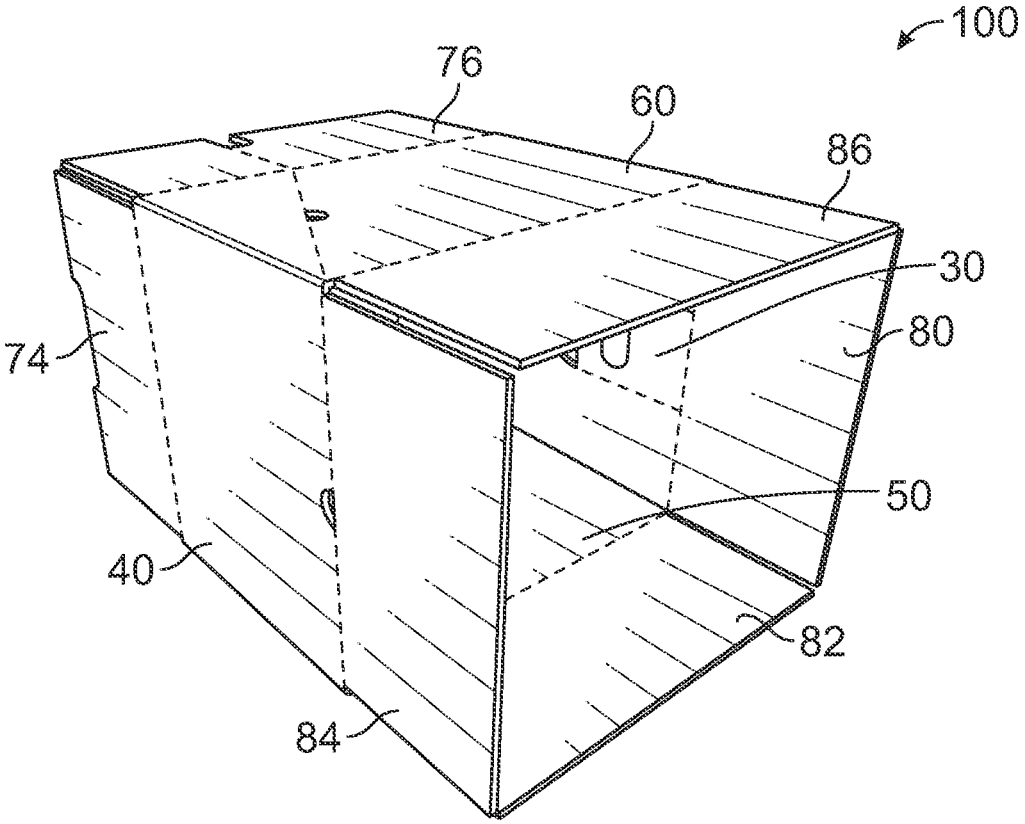

The container 100 may be formed by folding the front panel 30 over onto the first side panel 50 along the fold line at longitudinal edge 36; folding the second side panel 60 over onto the back panel 40 along the fold line at longitudinal edge 68; and adhesively securing the glue flap 60B to the front panel 30, see FIGS. 9 and 10. Thereafter, the container 100 may be partially erected such that the front panel 30 extends generally 90 degrees to the first side panel 50 and the second side panel 60, the first side panel 50 extends generally 90 degrees to the back panel 40 and the back panel 40 extends generally 90 degrees to the second side panel 60.

After the container 100 is partially erected, the first, second, third and fourth bottom flanges 80, 82, 84 and 86 may be folded inwardly so as to extend generally 90 degrees to front panel 30, the back panel 40 and the first and second side panels 50 and 60. The sequence in which the first, second, third and fourth flanges 80, 82, 84 and 86 are folded inwardly may be as follows: the first and third bottom flanges 80 and 84 are folded first and then the second and fourth bottom flanges 82 and 86 are folded over the first and third flanges 80 and 84. Adhesive may be provided between each adjacent flange 80, 82, 84 and 86 and/or tape may be used to secure the flanges 80, 82, 84 and 86 in position. The flanges 80, 82, 84 and 86 define the bottom 100B of the container 100.

Figure 1:
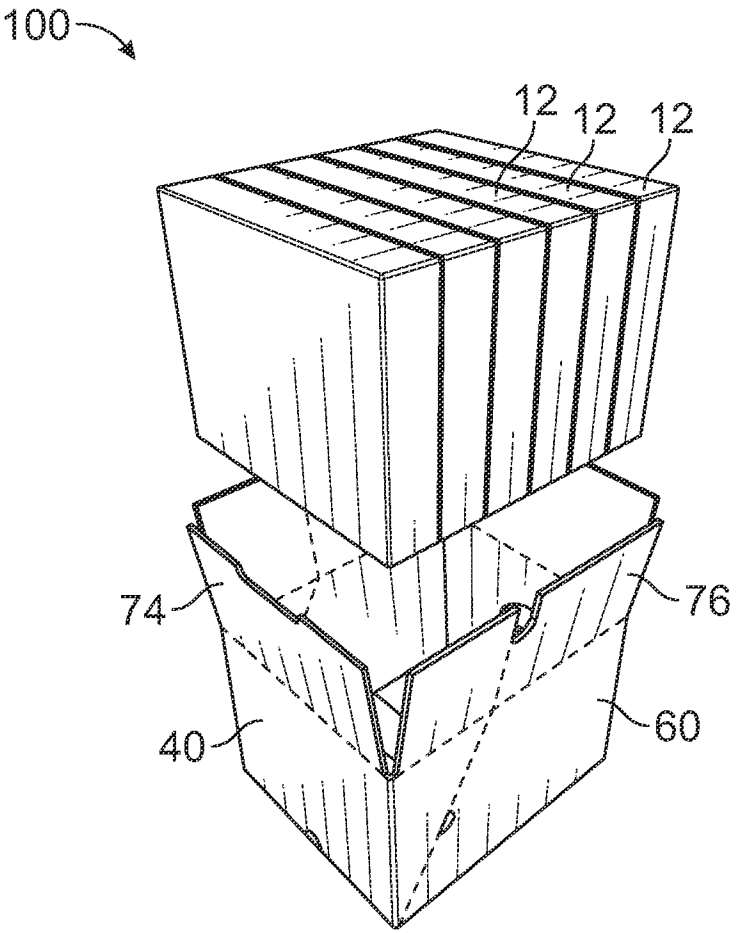
FIG. 1 is a perspective view of a container formed in accordance with a first embodiment in which boxes of product are about to be inserted.

After the flanges 80, 82, 84 and 86 have been folded and secured in position, the boxes 12 filled with product are inserted into the container 100, see FIG. 1. Thereafter, the first, second, third and fourth top flanges 70, 72, 74 and 76 may be folded inwardly so as to extend generally 90 degrees to the front panel 30, the back panel 40 and the first and second side panels 50 and 60. The sequence in which the first, second, third and fourth top flanges 70, 72, 74 and 76 are folded inwardly may be as follows: the first and third top flanges 70 and 74 are folded first and then the second and fourth top flanges 72 and 76 are folded over the first and third flanges 70 and 74. Adhesive may be provided between each adjacent flange 70, 72, 74 and 76 and/or tape may be used to secure the flanges 70, 72, 74 and 76 in position. The flanges 70, 72, 74 and 76 define the top 100A of the container 100.

Once the filled container 100 has been placed with its bottom on a shelf or like surface, the container 100 may be opened by removing the back portion 110 to create the product exit opening 110A so as to allow product to be easily dispensed onto the shelf, see FIGS. 3-7. The tab 120 may then be partially separated at the front panel 30 allowing the user to grasp the partially separated tab 120 with one hand H1 while the user inserts his/her other hand H2 through the opening 120A created by the partially separated tab 120 to push the product 12 out through the product exit opening 110A onto shelf or the like, see FIGS. 6 and 7.

Referring to FIGS. 12-15, a second embodiment of the present disclosure is directed to a shelf dispensing container or box 200 adapted to receive product, such as a plurality of cereal boxes 12. The container 200 may be formed from a blank B2, see FIG. 11.

Figure 11:
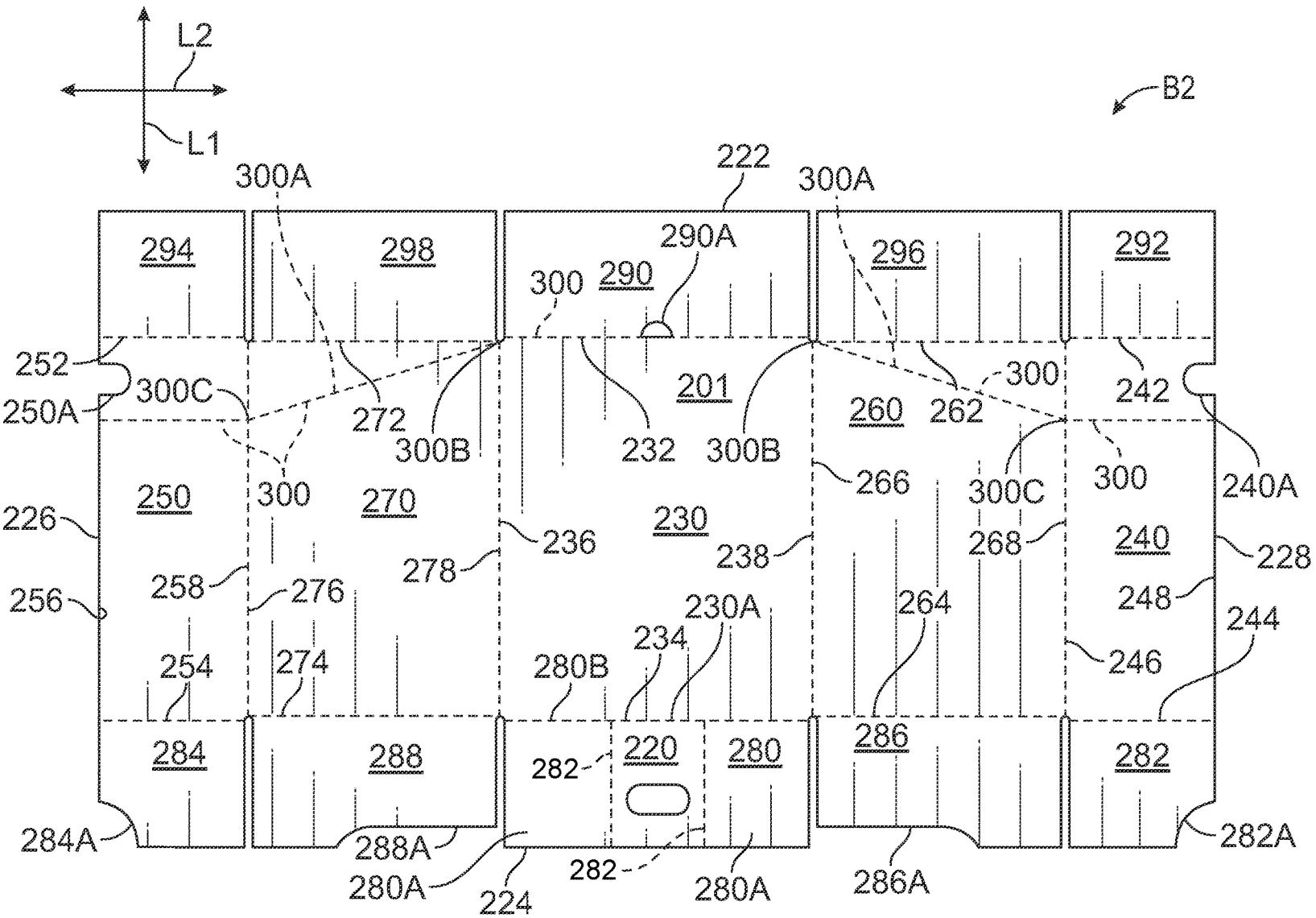
FIG. 11 is a plan view of a blank formed in accordance with a second embodiment of the present disclosure.

The blank B2 may be formed from paperboard, e.g., corrugated fiberboard or corrugated paperboard, and may be die cut to the shape shown herein, although other materials and variations of the illustrated shape may be provided within the scope of the container described and claimed herein. The blank B2 illustrated in FIG. 11 is a planar piece of material in which the inner side 201 is shown facing out of the page. The blank B2 extends in a lateral direction $L_1$ between first and second lateral edges 222 and 224, respectively, and further extends in a longitudinal direction $L_2$ between first and second longitudinal edges 226 and 228, respectively.

The blank B2 may comprise a bottom panel 230 having opposing lateral edges 232 and 234 and opposing longitudinal edges 236 and 238, a first top panel 240 having opposing lateral edges 242 and 244 and opposing longitudinal edges 246 and 248, a second top panel 250 having opposing lateral edges 252 and 254 and opposing longitudinal edges 256 and 258, a first side panel 260 having opposing lateral edges 262 and 264 and opposing longitudinal edges 266 and 268, and a second side panel 270 having opposing lateral edges 272 and 274 and opposing longitudinal edges 276 and 278. The first side panel 260 may be hingedly connected to the longitudinal edge 246 of the first top panel 240 at a fold line and hingedly connected to the longitudinal edge 238 of the bottom panel 230 along a fold line. The second side panel 270 may be hingedly connected to the longitudinal edge 258 of the second top panel 250 at a fold line and hingedly connected to the longitudinal edge 236 of the bottom panel 230 along a fold line.

A first front flange 280 is hingedly connected to the bottom panel 230 along a fold line defined at the lateral edge 234 of the bottom panel 230; a second front flange 282 is hingedly connected to the first top panel 240 along a fold line defined at the lateral edge 244 of the first top panel 240; a third front flange 284 is hingedly connected to the second top panel 250 along a fold line defined at the lateral edge 254 of the second top panel 250; a fourth front flange 286 is hingedly connected to the first side panel 260 along a fold line defined at the lateral edge 264 of the first side panel 260; and a fifth front flange 288 is hingedly connected to the second side panel 270 along a fold line defined at the lateral edge 274 of the second side panel 270.

A first back flange 290 is hingedly connected to the bottom panel 230 along a fold line defined at the lateral edge 232 of the bottom panel 230; a second back flange 292 is hingedly connected to the first top panel 240 along a fold line defined at the lateral edge 242 of the first top panel 240; a third back flange 294 is hingedly connected to the second top panel 250 along a fold line defined at the lateral edge 252 of the second top panel 250; a fourth back flange 296 is hingedly connected to the first side panel 260 along a fold line defined at the lateral edge 262 of the first side panel 260; and a fifth back flange 298 is hingedly connected to the second side panel 270 along a fold line defined at the lateral edge 272 of the second side panel 270.

Figure 14:
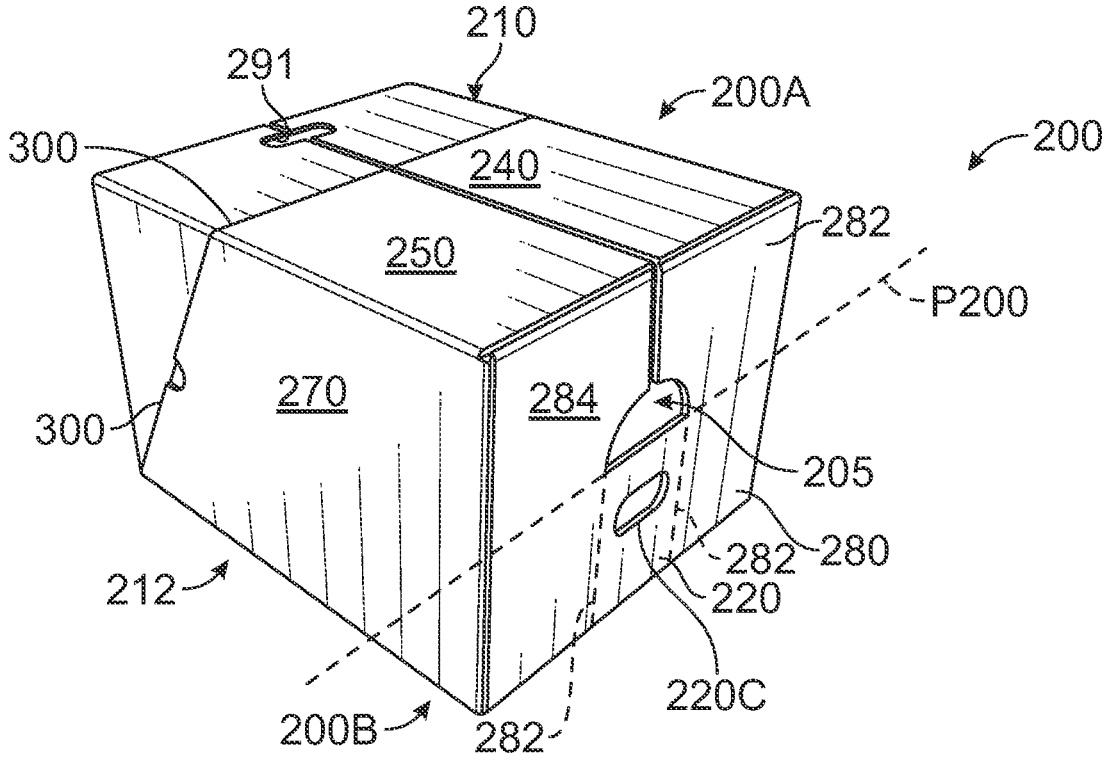
FIG. 14 illustrates a formed container of the second embodiment.

Back lines of separation 300 may be formed in the first and second top panels 240 and 260, the first and second side panels 260 and 270 and at or near the lateral edge 232 of the bottom panel 230, i.e., at or near an interface between the bottom panel 230 and the first back flange 290, to define the outer periphery of a removable back portion 210, see FIGS. 11 and 14. The back lines of separation 300 may comprise score lines, nicked cut lines or perforation lines and allow the removable back portion 210 to be manually separated by a user via the back lines of separation 300 from a remainder 212 of the container 200 so as to create a product exit opening 210A.

The back lines of separation 300A formed in each of the first and second side panels 260 and 270 may extend at an angle across each of the first and second side panels 260 and 270 from a first location 300B near one of the corresponding lateral edges 262/272 and one of the corresponding longitudinal edges 266/278 to a second location 300C near another one of the corresponding longitudinal edges 268/276 but spaced from the corresponding lateral edges 262/264/272/274.

A finger hole or opening 290A may be provided in the first back flange 290 and a grasping opening 291 may be defined by notches 240A and 250A formed in the first and second top panels 240 and 250, see FIGS. 11 and 14, to allow a user to easily grasp the back portion 210 to remove the back portion 210 from the remainder 212 of the container 200.

Front lines of separation 283, such as score lines, nicked cut lines or perforation lines, may be formed in the first front flange 280 to define a tab 220, wherein the tab 220 is located near the lateral edge 234 of the bottom panel 230 in the illustrated embodiment, see FIG. 11. A notch or opening 205 may be formed in the container 200 just above the tab 220, see FIG. 14, which notch 205 is defined by recesses 282A, 284A, 286A and 288A formed in the second, third, fourth and fifth front flanges 282, 284, 286 and 288. A user can access the tab 220 via the notch 205 and pull the tab 220 away from a remainder 280A of the first front flange 280 such that the tab 220 separates along the front lines of separation 283 and defines an opening 220A in the container 200. The separated tab 220 continues to be joined to the container 100 along a lower edge 220B of the tab 220 and at or near a lower end 280B of the first front flange 280 or at an adjacent portion 230A of the bottom panel 230, see FIGS. 11 and 15. A gripping opening 220C may be formed in the tab 220. A user may grasp the partially separated tab 220 via the gripping opening 220C with one hand H1 while the user inserts his/her other hand H2 through the opening 220A in the container 200 created by the partially separated tab 220 to push product 12 out through the product exit opening 210A onto a shelf or the like. It is advantageous that the tab 220 remains joined at or near the lower end 280B of the first front flange 280. The container 200 comprises a middle plane $P_{200}$ located approximately half way between a top 200A of the container 200 and a bottom 200B of the container 200. In order to reduce the likelihood that the boxes 12 may bind on the inner surfaces of the first and second side panels 260 and 270 and/or one or more of the first and second top panels 240 and 250 as they are pushed out of the container 200, it is preferred that the opening 220A extend from near the middle plane $P_{200}$ to point at or near the lower end 280B of the first front flange 280 to allow the user's other hand H2 to apply a force directly in-line with the center of mass of the boxes 12, which may be located below the middle plane $P_{200}$, wherein the force may be a substantially horizontal force if the container 200 is positioned on a horizontal surface.

Figure 12:
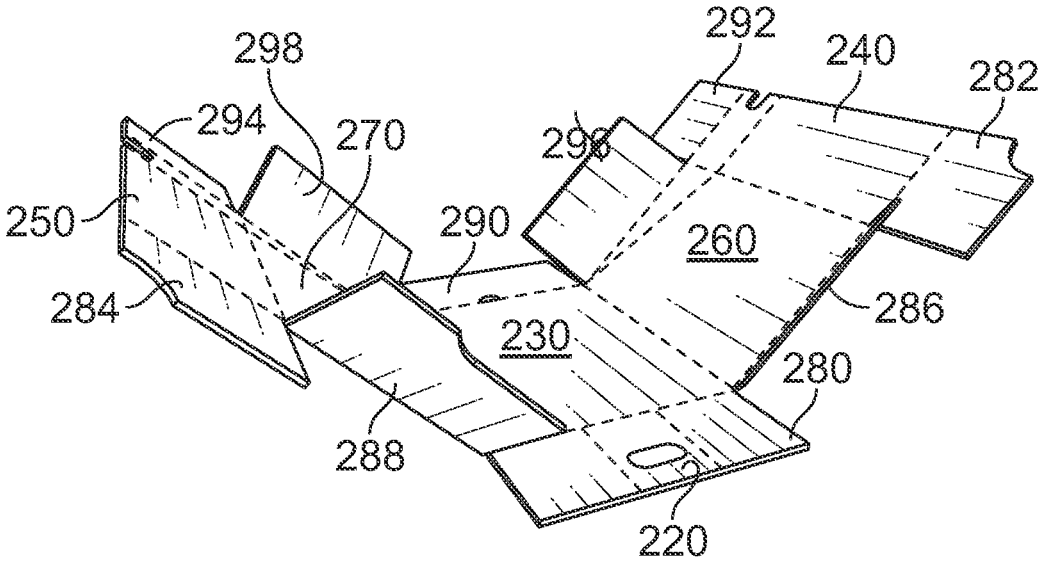
FIG. 12 illustrates steps for folding the blank of FIG. 11 into a container.

The container 200 may be formed by folding the first and second side panels 260 and 270 generally 90 degrees to the bottom panel 230, see FIG. 12. Thereafter, the fourth and fifth front flanges 286 and 288 and the fourth and fifth back flanges 296 and 298 are folded generally 90 degrees to the first and second side panels 260 and 270, see FIG. 13. Then, the first front flange 280 is folded generally 90 degrees to the bottom panel 230 and secured to the fourth and fifth front flanges 286 and 288 and the first back flange 290 is folded generally 90 degrees to the bottom panel 230 and secured to the fourth and fifth back flanges 296 and 298, via adhesive, tape or other fastening structure, see FIG. 13, such that the container 200 is partially erected.

Figure 13:
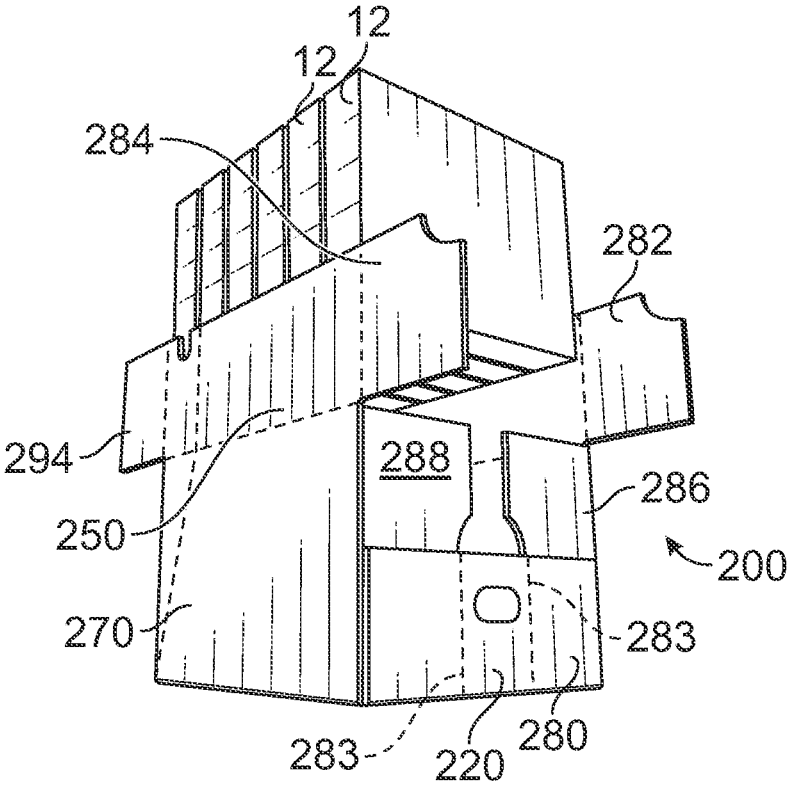
FIG. 13 illustrates boxes of product about to be inserted into a partially erected container formed in accordance with a second embodiment.

After the container 200 is partially erected, boxes 12 filled with product are inserted into the container 200, see FIG. 13. Thereafter, the first and second top panels 240 and 250 are folded generally 90 degrees to the first and second side panels 260 and 270 and the second and third front flanges 282 and 284 and second and third back flanges 292 and 294 are folded onto and secured to fourth and fifth front flanges 286 and 288 and the fourth and fifth back flanges 296 and 298 via adhesive, tape or the like, see FIGS. 13 and 14.

Figure 15:
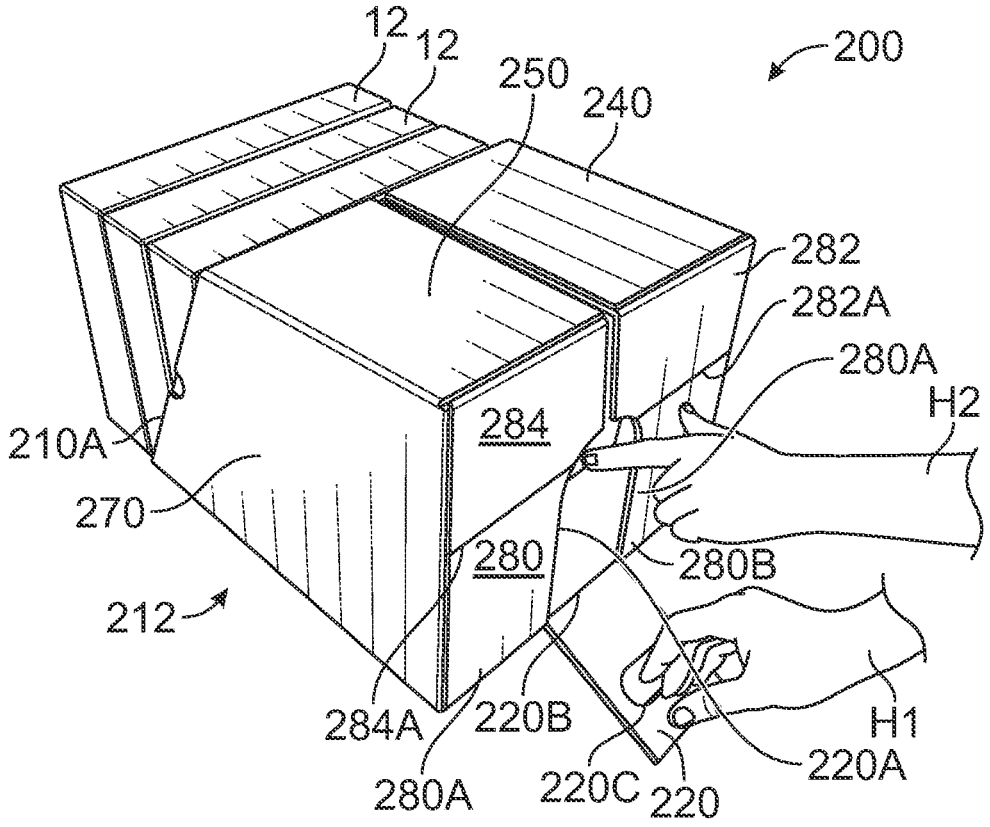
FIG. 15 illustrates the container of FIG. 14 showing a user grasping a tab with one hand and pushing boxes of product out of the container with the other hand.

Once the filled container 200 has been placed with its bottom panel 230 on a shelf or like surface, the container 200 may be opened by removing the back portion 210 to create the product exit opening 210A so as to allow product to be easily dispensed onto a shelf, see FIG. 15. The tab 220 may then be partially separated at the first front flange 280 allowing the user to grasp the partially separated tab 220 with one hand H1 while the user inserts his/her other hand H2 through the opening 220A created by the partially separated tab 220 to push the product 12 out through the product exit opening 210A onto a shelf or the like, see FIG. 15.

Figure 16:
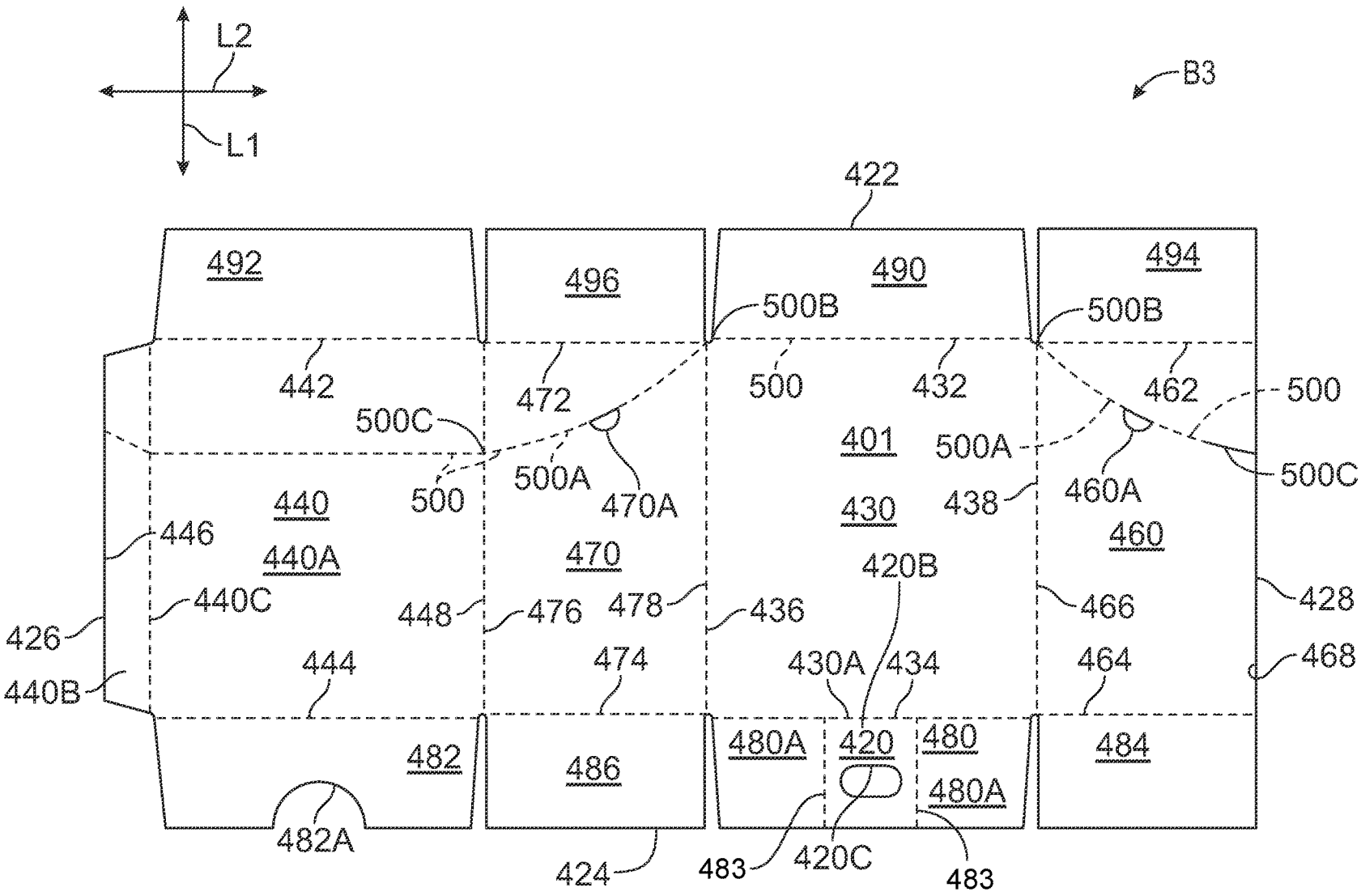
FIG. 16 is a plan view of a blank formed in accordance with a third embodiment of the present disclosure.
Figure 17:
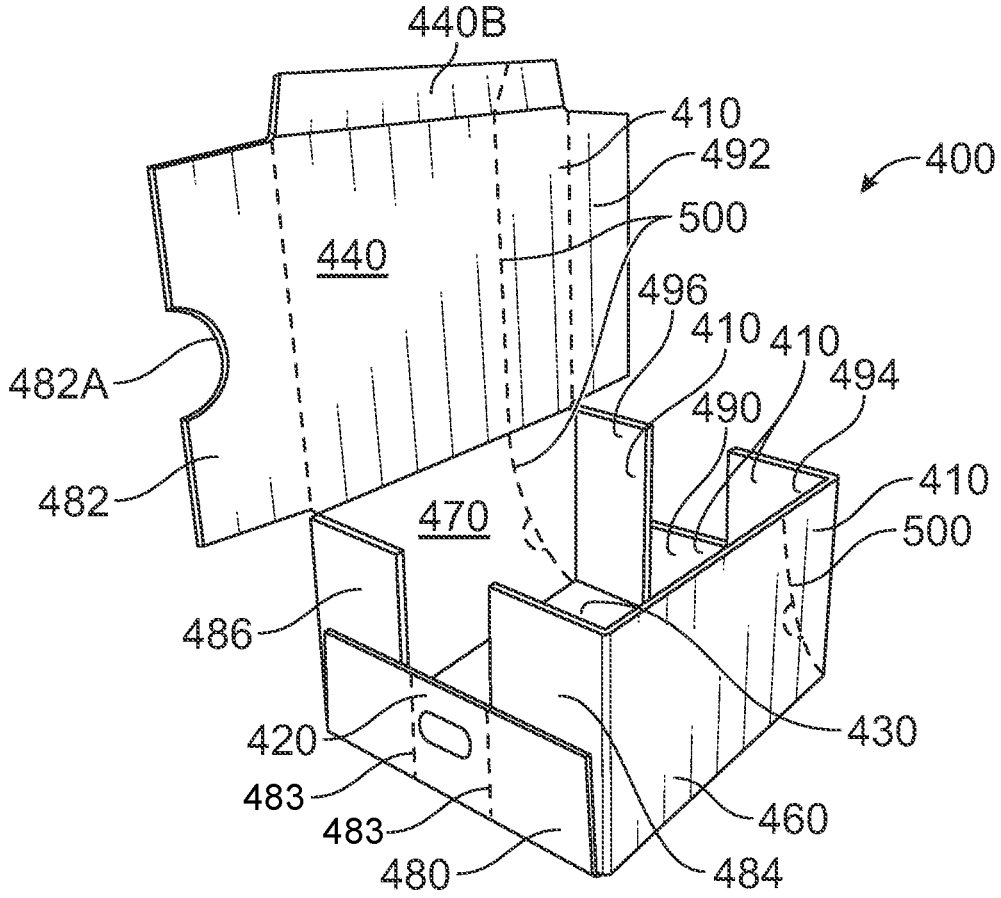
FIG. 17 illustrates a partially erected container formed from the blank of FIG. 16.
Figure 18:
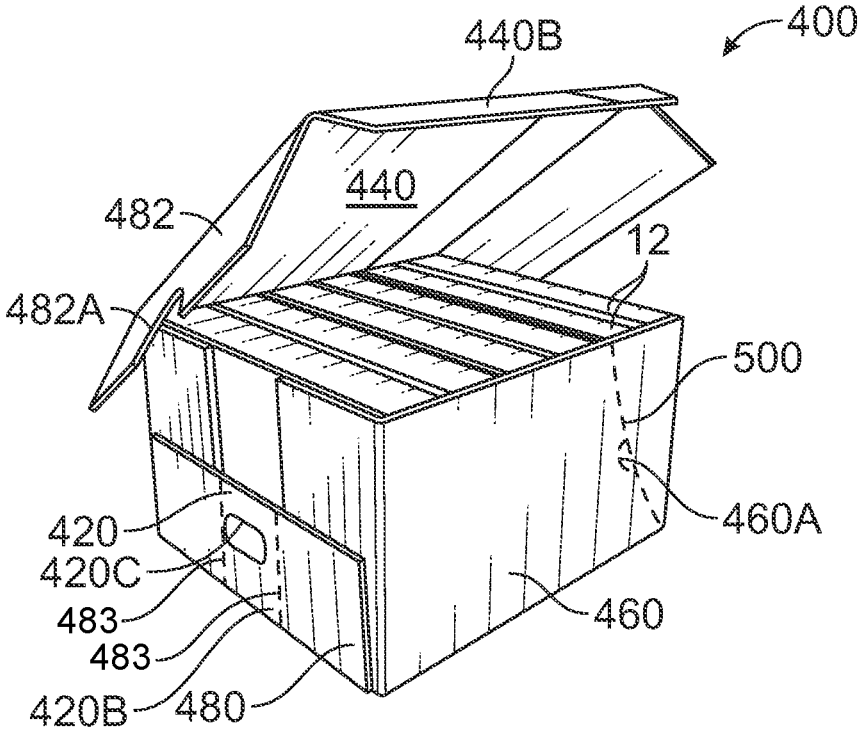
FIG. 18 illustrates boxes of product inserted into the partially erected container of FIG. 17.
Figure 19:
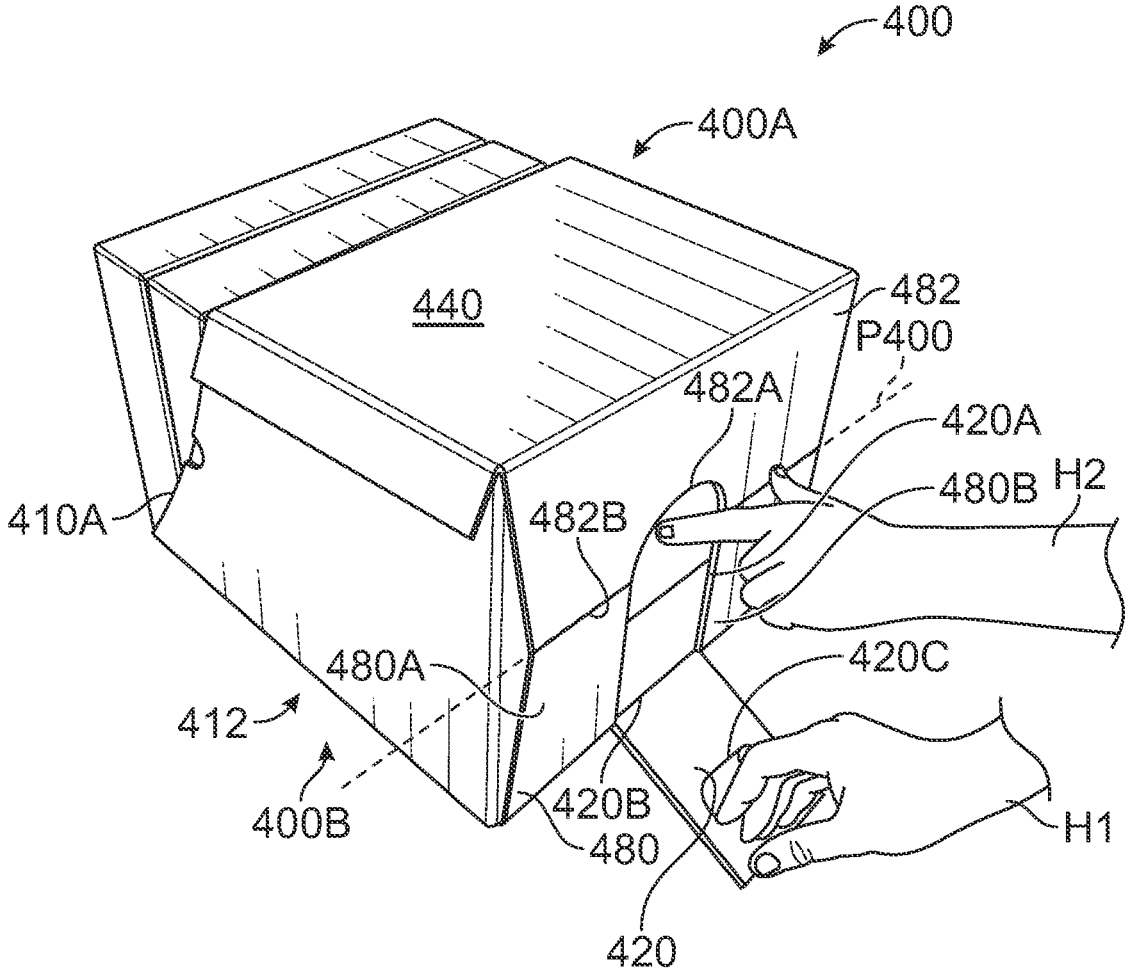
FIG. 19 illustrates the container of FIG. 18 showing a user grasping a tab with one hand and pushing boxes of product out of the container with the other hand.

Referring to FIGS. 17-19, a third embodiment of the present disclosure is directed to a shelf dispensing container or box 400 adapted to receive product, such as a plurality of cereal boxes 12. The container 400 may be formed from a blank B3, see FIG. 16.

The blank B3 may be formed from paperboard, e.g., corrugated fiberboard or corrugated paperboard, and may be die cut to the shape shown herein, although other materials and variations of the illustrated shape may be provided within the scope of the container described and claimed herein. The blank B3 illustrated in FIG. 16 is a planar piece of material in which the inner side 401 is shown facing out of the page. The blank B3 extends in a lateral direction $L_1$ between first and second lateral edges 422 and 424, respectively, and further extends in a longitudinal direction $L_2$ between first and second longitudinal edges 426 and 428, respectively.

The blank B3 may comprise a bottom panel 430 having opposing lateral edges 432 and 434 and opposing longitudinal edges 436 and 438, a top panel 440 having opposing lateral edges 442 and 444 and opposing longitudinal edges 446 and 448, a first side panel 460 having opposing lateral edges 462 and 464 and opposing longitudinal edges 466 and 468, and a second side panel 470 having opposing lateral edges 472 and 474 and opposing longitudinal edges 476 and 478. The first side panel 460 may be hingedly connected to the longitudinal edge 438 of the bottom panel 430 at a fold line. The second side panel 470 may be hingedly connected to the longitudinal edge 448 of the top panel 440 at a fold line and hingedly connected to the longitudinal edge 436 of the bottom panel 430 along a fold line. The top panel 440 may comprise a primary top panel 440A and a glue flap 440B coupled to a longitudinal edge 440C of the primary top panel 440A.

A first front flange 480 is hingedly connected to the bottom panel 430 along a fold line defined at the lateral edge 434 of the bottom panel 430; a second front flange 482 is hingedly connected to the top panel 440 along a fold line defined at the lateral edge 444 of the top panel 440; a third front flange 484 is hingedly connected to the first side panel 460 along a fold line defined at the lateral edge 464 of the first side panel 460; and a fourth front flange 486 is hingedly connected to the second side panel 470 along a fold line defined at the lateral edge 474 of the second side panel 470.

A first back flange 490 is hingedly connected to the bottom panel 430 along a fold line defined at the lateral edge 432 of the bottom panel 430; a second back flange 492 is hingedly connected to the top panel 440 along a fold line defined at the lateral edge 442 of the top panel 440; a third back flange 494 is hingedly connected to the first side panel 460 along a fold line defined at the lateral edge 462 of the first side panel 460; and a fourth back flange 496 is hingedly connected to the second side panel 470 along a fold line defined at the lateral edge 472 of the second side panel 470.

Back lines of separation 500 may be formed in the top panel 440, the first and second side panels 460 and 470 and at or near the lateral edge 432 of the bottom panel 430, i.e., at or near an interface between the bottom panel 430 and the first back flange 490, to define the outer periphery of a removable back portion 410, see FIG. 17. The back lines of separation 500 may comprise score lines, nicked cut lines or perforation lines and allow the removable back portion 410 to be manually separated by a user via the back lines of separation 500 from a remainder 412 of the container 400 so as to create a product exit opening 410A.

Back lines of separation 500A formed in each of the first and second side panels 460 and 470 may extend at an angle, i.e., along an arc as illustrated or a straight line, across each of the first and second side panels 460 and 470 from a first location 500B near one of the corresponding lateral edges 462/472 and one of the corresponding longitudinal edges 466/478 to a second location 500C near another one of the corresponding longitudinal edges 468/476 but spaced from the corresponding lateral edges 462/464/472/474.

Finger holes or openings 460A and 470A may be provided in the first and second side panels 460 and 470, see FIG. 16, to allow a user to easily grasp the back portion 410 to remove the back portion 410 from the remainder 412 of the container 400.

Front lines of separation 483, such as score lines, nicked cut lines or perforation lines, may be formed in the first front flange 480 to define a tab 420, wherein the tab 420 is located near the lateral edge 434 of the bottom panel 430 in the illustrated embodiment, see FIG. 16. A grasping notch 482A may be defined in the second front flange 482 so as to be positioned just above the tab 420 when the container is erected, see FIG. 19. A user can access the tab 420 via the notch 482A and pull the tab 420 away from a remainder 480A of the first front flange 480 such that the tab 420 separates along the front lines of separation 483 and defines an opening 420A in the container 400. The separated tab 420 continues to be joined to the container 400 along a lower edge 420B of the tab 220 and at or near a lower end 480B of the first front flange 480 or at an adjacent portion 430A of the bottom panel 430, see FIG. 19. A gripping opening 420C may be formed in the tab 420. A user may grasp the partially separated tab 420 via the gripping opening 420C with one hand H1 while the user inserts his/her other hand H2 through the opening 420A in the container 400 created by the partially separated tab 420 to push product 12 out through the product exit opening 410A onto a shelf or the like, see FIG. 19. It is advantageous that the tab 420 remains joined at or near the lower end 480B of the first front flange 480. The container 400 comprises a middle plane $P_{400}$ located approximately half way between a top 400A of the container 400 and a bottom 400B of the container 400. In order to reduce the likelihood that the boxes 12 may bind on the inner surfaces of the first and second side panels 460 and 470 and/or the top panel 440 as they are pushed out of the container 400, it is preferred that the opening 420A extend from near the middle plane $P_{400}$ to a point at or near the lower end 480B of the first front flange 480 to allow the user's other hand H2 to apply a force directly in-line with the center of mass of the boxes 12, which may be located below the middle plane $P_{400}$, wherein the force may be a substantially horizontal force if the container 400 is positioned on a horizontal surface.

The container 400 may be formed by folding the first and second side panels 460 and 470 generally 90 degrees to the bottom panel 430, see FIG. 17. Thereafter, the third and fourth front flanges 484 and 486 and the third and fourth back flanges 494 and 496 are folded generally 90 degrees to the first and second side panels 460 and 470, see FIG. 17. The first front flange 480 is then folded generally 90 degrees to the bottom panel 430 and secured to the third and fourth front flanges 484 and 486 and the first back flange 490 is folded generally 90 degrees to the bottom panel 230 and secured to the third and fourth back flanges 494 and 496 via adhesive, tape or other fastening structure, see FIG. 17, such that the container 400 is partially erected.

After the container 400 is partially erected, boxes 12 filled with product are inserted into the container 400, see FIG. 18. Thereafter, the top panel 440 is folded generally 90 degrees to the second side panel 470, the glue flap 440B is secured to the first side panel 460 via adhesive or tape, and the second front flange 482 and second back flanges 492 are folded onto and secured to the third and fourth front flanges 484 and 486 and to the third and fourth back flanges 494 and 496 via adhesive, tape or the like, see FIGS. 18 and 19.

Once the filled container 400 has been placed with its bottom panel 430 on a shelf or like surface, the container 400 may be opened by removing the back portion 410 to create the product exit opening 410A so as to allow product to be easily dispensed onto a shelf, see FIG. 19. The tab 420 may then be partially separated at the first front flange 480 allowing the user to grasp the partially separated tab 420 with one hand H1 while the user inserts his/her other hand H2 through the opening 420A created by the partially separated tab 420 to push the product 12 out through the product exit opening 410A onto a shelf or the like, see FIG. 19.

While particular embodiments of the present invention have been illustrated and described, it should be understood that various changes and modifications may be made without departing from the spirit and scope of the invention. It is therefore intended to cover in the appended claims all such changes and modifications that are within the scope of this invention.

The invention claimed is:

1. A container adapted to contain product comprising:

a bottom panel, at least one top panel, a first side panel, a second side panel, a plurality of front flanges and a plurality of back flanges, wherein the panels and flanges are connected together to define the container;

back lines of separation formed in the first and second side panels, the at least one top panel, and at or near an interface between the bottom panel and one of the back flanges, such that a removable back portion can be separated from a remainder of the container via the back lines of separation so as to create a product exit opening and the back lines of separation do not extend onto the back flanges;

front lines of separation formed in one of the front flanges to define a tab, which is partially separable, wherein the front lines of separation are spaced away from the at least one top panel and do not extend onto the bottom panel, and wherein the tab continues to be joined to the container at or near a lower end of the one front flange or an adjacent portion of the bottom panel when the tab is partially separated and the tab comprises a lower edge adjacent to the lower end of the front panel and an upper edge opposite the lower edge, wherein at least one of the other front flanges comprises a notch that is positioned adjacent to the upper edge of the tab.

2. The container of claim 1, wherein the tab includes a gripping opening allowing a user to grasp the partially separated tab with one hand while the user inserts his/her other hand through an opening created by the partially separated tab after being separated to push product out through the product exit opening.

3. The container of claim 1, wherein the at least one top panel comprises first and second top panels.

4. The container of claim 1, wherein the at least one top panel comprises a primary top panel and further comprising a glue flap coupled to the primary top panel along a longitudinal edge of the primary top panel.

5. The container of claim 1, wherein the one front flange is hingedly connected to a lateral edge of the bottom panel.

6. The container of claim 1, wherein each of the first and second side panels comprises opposing lateral edges and opposing longitudinal edges, wherein a back line of separation extends across each of the first and second side panels from a first location near one of the corresponding lateral edges and one of the corresponding longitudinal edges to a second location near another one of the corresponding longitudinal edges but spaced from the corresponding lateral edges.

* * * * *